US009150018B2

(12) United States Patent
Nakao

(10) Patent No.: US 9,150,018 B2
(45) Date of Patent: Oct. 6, 2015

(54) LIQUID EJECTING HEAD AND LIQUID EJECTING APPARATUS

(71) Applicant: Seiko Epson Corporation, Tokyo (JP)

(72) Inventor: Hajime Nakao, Azumino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/183,993

(22) Filed: Feb. 19, 2014

(65) Prior Publication Data

US 2014/0267505 A1 Sep. 18, 2014

(30) Foreign Application Priority Data

Mar. 12, 2013 (JP) ..... 2013-048971

(51) Int. Cl.
*B41J 2/015* (2006.01)
*B41J 2/14* (2006.01)

(52) U.S. Cl.
CPC .... *B41J 2/14233* (2013.01); *B41J 2002/14491* (2013.01); *B41J 2202/11* (2013.01)

(58) Field of Classification Search
None
See application file for complete search history.

(56) References Cited

U.S. PATENT DOCUMENTS

| | | | | |
|---|---|---|---|---|
| 5,530,465 | A | 6/1996 | Hasegawa et al. | |
| 2003/0214564 | A1* | 11/2003 | Miyata | 347/72 |
| 2006/0124456 | A1* | 6/2006 | Murai | 204/298.12 |
| 2007/0211105 | A1* | 9/2007 | Furukawa | 347/45 |
| 2011/0234707 | A1* | 9/2011 | Gao | 347/70 |

FOREIGN PATENT DOCUMENTS

| | | | |
|---|---|---|---|
| JP | 2003237076 | A * | 8/2003 |
| WO | WO-9322140 | A1 | 11/1993 |

* cited by examiner

*Primary Examiner* — Erica Lin
(74) *Attorney, Agent, or Firm* — Harness, Dickey & Pierce, P.L.C.

(57) ABSTRACT

A liquid ejecting head that ejects liquid includes a flow path member that includes a plurality of pressure chambers through which the liquid flows, pressure generation elements that include active parts arranged at positions corresponding to the pressure chambers and a common electrode for generating a common potential to the respective pressure chambers, and a conductive member that is electrically connected to the common electrode on the flow path member at the side to which the pressure generation elements are fixed and lowers resistance of the common electrode.

4 Claims, 7 Drawing Sheets

LIQUID EJECTING HEAD AND LIQUID EJECTING APPARATUS

BACKGROUND

1. Technical Field

The present invention relates to a liquid ejecting head that ejects liquid and a liquid ejecting apparatus.

2. Related Art

Known has been an existing liquid ejecting head that ejects liquid in accordance with pressure fluctuations in a flow path. The liquid ejecting head includes a flow path member including pressure chambers forming a part of the liquid flow path and pressure generation elements such as piezoelectric elements and heat generation elements. The pressure generation elements are arranged on the flow path member so as to correspond to positions of the pressure chambers. If the pressure generation elements are driven so as to generate the pressure fluctuations in the pressure chambers, the liquid ejecting head ejects liquid (for example, see Japanese Patent No. 3379106).

Normally, the pressure generation elements include electrodes for driving the pressure generation elements. The electrodes are constituted by a common electrode and individual electrodes. The common electrode generates a common potential on respective active parts of the pressure generation elements. The individual electrodes generate individual potentials (signals) on the respective active parts of the pressure generation elements.

In the liquid ejecting head, as density of nozzle holes through which liquid is discharged is increased, sizes of the pressure chambers and sizes of the electrodes become smaller. If the sizes of the electrodes are made small, wiring resistance is increased and the potentials to be supplied are not appropriate values. This results in deterioration of discharge performance of the liquid.

SUMMARY

An advantage of some aspects of the invention is to provide a liquid ejecting head that keeps optimal discharge performance and a liquid ejecting apparatus.

A liquid ejecting head that ejects liquid according to an aspect of the invention includes a flow path member that includes a plurality of pressure chambers through which the liquid flows, pressure generation elements that include active parts arranged at positions corresponding to the pressure chambers and a common electrode for generating a common potential on the respective pressure chambers, and a conductive member that is electrically connected to the common electrode on the flow path member at the side to which the pressure generation elements are fixed, and lowers resistance of the common electrode.

In the aspect of the invention configured as described above, the common electrode of the pressure generation elements is electrically connected to the conductive member located on the flow path member at the same side.

Therefore, the common electrode and the conductive member are electrically integrated so as to lower the wiring resistance of the common electrode. As a result, electric crosstalk between the pressure generation elements and dullness of driving signals for driving the pressure generation elements can be improved. Further, a wiring region of the common electrode can be made small, thereby reducing the liquid ejecting head in size.

The pressure generation element includes a heat generation element that vaporizes liquid to generate pressure and a piezoelectric element that generates pressure with mechanical distortion. When the pressure generation elements are the heat generation elements, the active parts are constituted by heat generators such as heaters. When the pressure generation elements are the piezoelectric elements, the active parts are constituted by piezoelectric bodies sandwiched between the electrodes.

A novel member may be applied to or an existing head member accommodating the piezoelectric elements, or the like, may be applied to the conductive member. Further, any material may be used for the conductive member as long as it has conductive property. Gold (Au), platinum (Pt), stainless steel (SUS), or the like can be applied as the material of the conductive member.

In the liquid ejecting head according to the aspect of the invention, it is preferable that the conductive member form a part of a wall of a flow path through which the liquid flows and which communicates with the pressure chambers.

In the aspect of the invention configured as described above, the conductive member forms a part of the flow path of the liquid, thereby reducing the size of the liquid ejecting head.

In the liquid ejecting head according to the aspect of the invention, it is preferable that the conductive member and the liquid be electrically connected to each other.

In the aspect of the invention configured as described above, a potential of the liquid applied through the conductive member is set to be the same as a potential generated on the common electrode, thereby stabilizing the potential that is generated on the common electrode.

In the liquid ejecting head according to the aspect of the invention, it is preferable that the conductive member communicate with the plurality of pressure chambers and serve as a common liquid chamber shared by the respective pressure chambers.

In the aspect of the invention configured as described above, the common liquid chamber is provided at the outside of the flow path member so as to simplify a shape of the flow path formed on the flow path member. As a result, the size of the liquid ejecting head can be reduced.

In the liquid ejecting head according to the aspect of the invention, it is preferable that the common electrode include individual electrodes arranged for the respective pressure chambers, and the individual electrodes are conductive with one another through the conductive member.

In the aspect of the invention configured as described above, the common electrode can be configured by combining the individual electrodes, thereby creating the common electrode easily.

The aspect of the invention can be also applied to a liquid ejecting apparatus including the liquid ejecting head as described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention are described in accordance with the following order.

First Embodiment
Second Embodiment
Other Embodiments

First Embodiment

Figure 1:
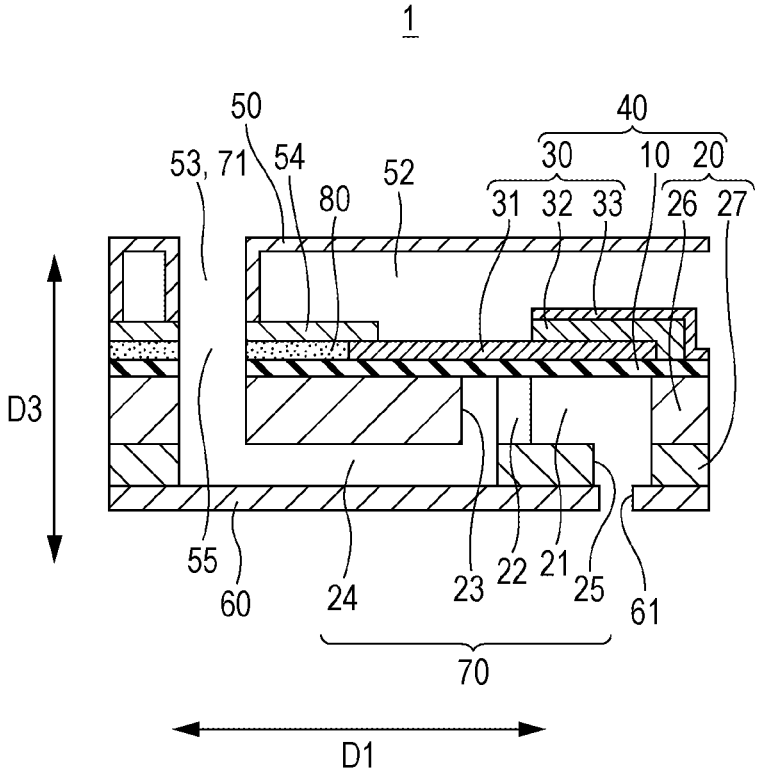
FIG. 1 is a cross-sectional view for explaining a configuration of a liquid ejecting head.
Figure 2:
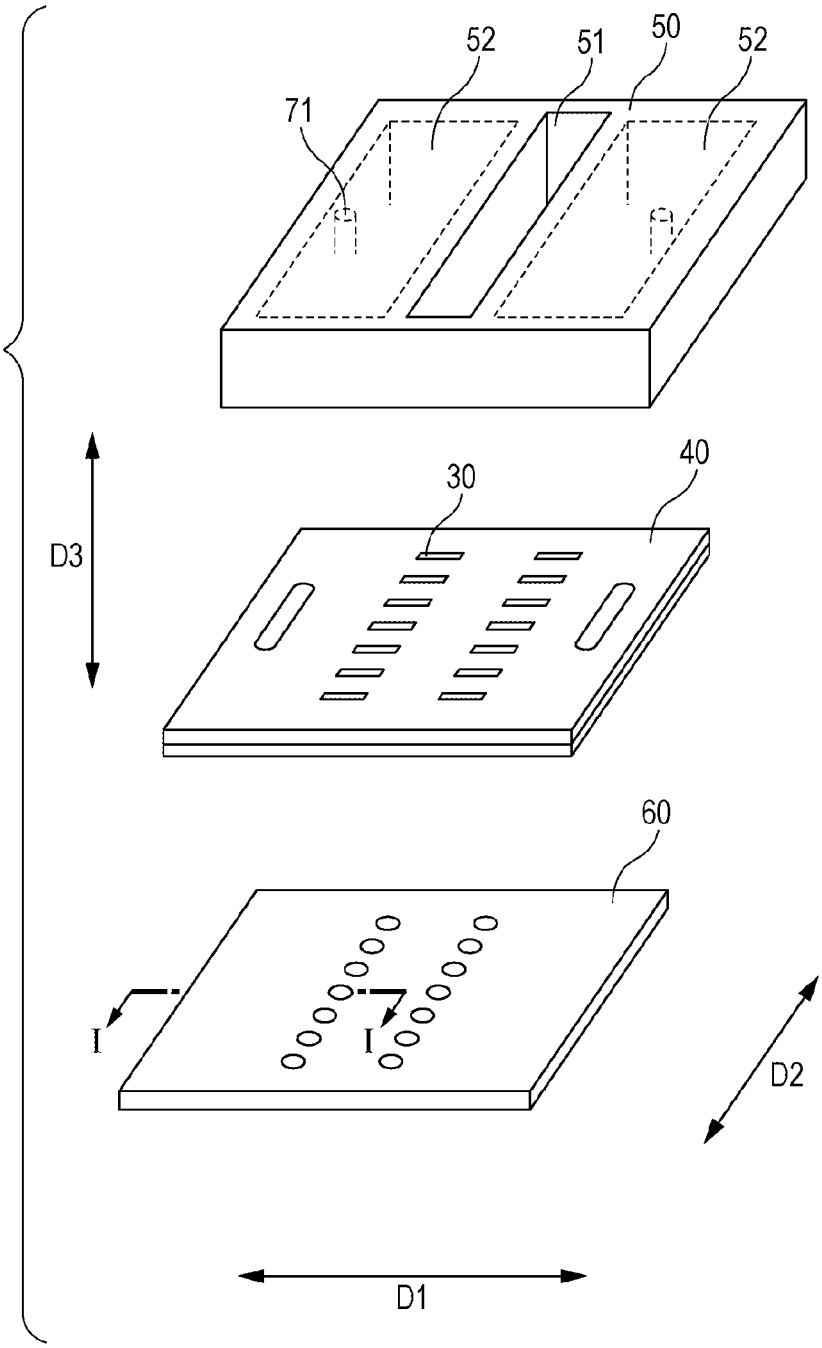
FIG. 2 is a perspective developed view for explaining the configuration of the liquid ejecting head.
Figure 3:
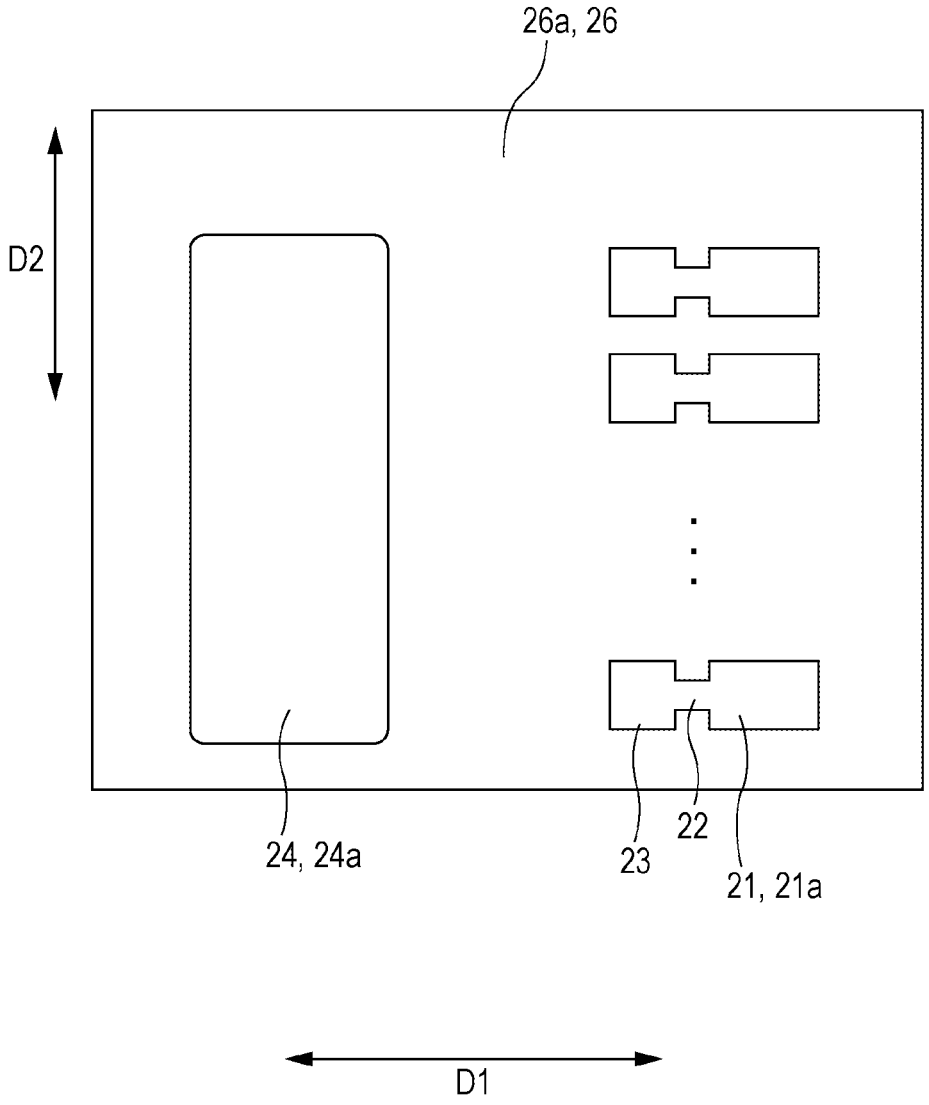
FIG. 3 is a view for explaining positional relationship between pressure chambers and a reservoir chamber.
Figure 4:
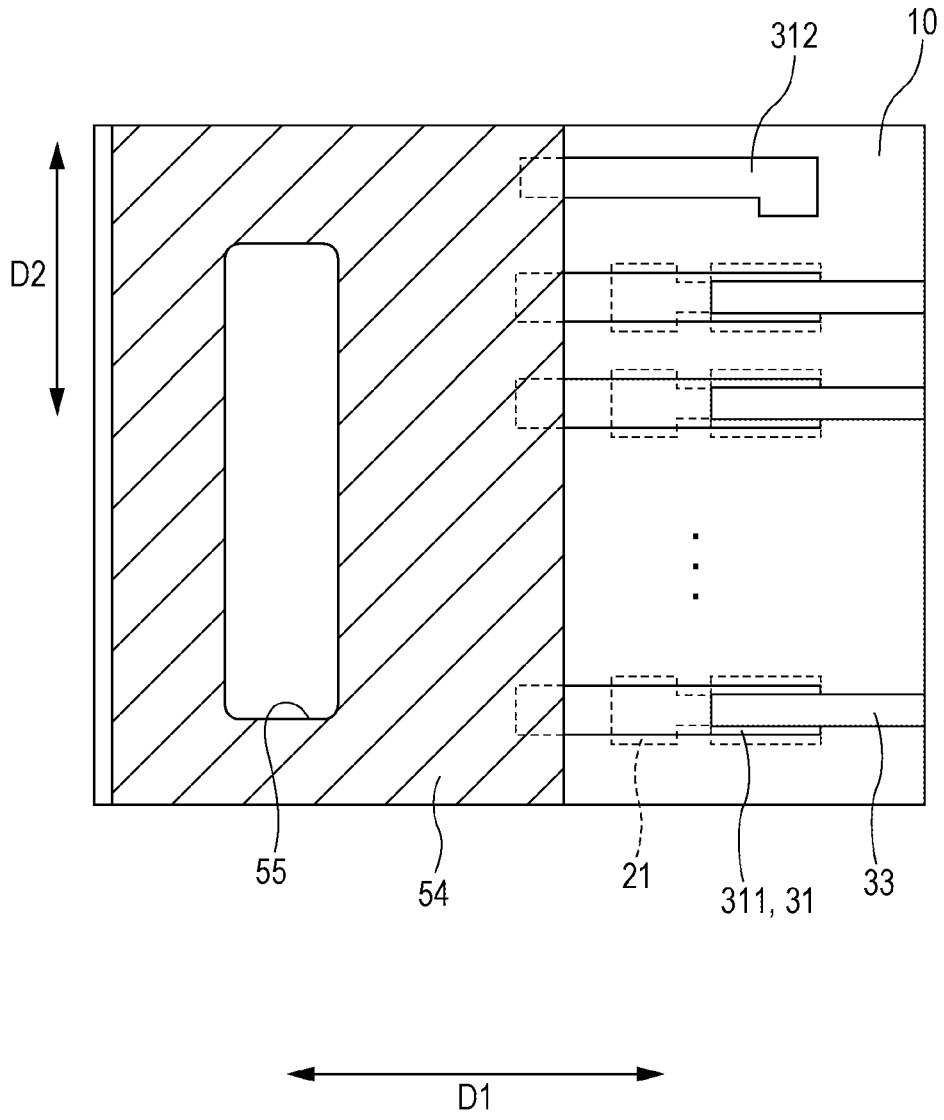
FIG. 4 is a view for explaining positional relationship of respective electrodes.

Hereinafter, a first embodiment to which a liquid ejecting head according to the invention is embodied is described with reference to the drawings. FIG. 1 is a cross-sectional view for explaining a configuration of the liquid ejecting head. FIG. 2 is a perspective developed view for explaining the configuration of the liquid ejecting head. FIG. 1 corresponds to a cross-sectional view cut along a line I-I in FIG. 2. FIG. 3 is a view for explaining positional relationship between pressure chambers and a reservoir chamber. FIG. 4 is a view for explaining positional relationship of respective electrodes.

A liquid ejecting head 1 is used as a part of a liquid ejecting apparatus such as a printing apparatus. As illustrated in FIG. 1 and FIG. 2, the liquid ejecting head 1 includes a flow path unit 40, a nozzle plate 60, and a head member 50. In the liquid ejecting head 1, the flow path unit 40 and the nozzle plate 60 as mentioned above are combined in a laminate manner so as to form a liquid flow path 70 therein.

The flow path unit 40 includes a vibration plate 10, a flow path formation substrate 20, and piezoelectric elements (pressure generation elements) 30. The flow path formation substrate 20 and the vibration plate 10 constitute a flow path member according to the invention. Although description is made while the flow path unit 40 includes the piezoelectric elements 30 in the embodiment, the flow path unit 40 may not include the piezoelectric elements 30.

A plurality of pressure chambers 21 and common liquid chambers 24 are formed on the flow path formation substrate 20. The pressure chambers 21 are portions on which pressure fluctuations are generated on the liquid flow path 70. Further, the common liquid chambers 24 are spaces serving as flow paths common to the respective pressure chambers 21 through which ink of the same color flows, for example. Although the flow path formation substrate 20 is configured by laminating a first substrate 26 and a second substrate 27 as thin plate members in the embodiment, the configuration of the flow path formation substrate 20 is not limited thereto.

As illustrated in FIG. 3, the plurality of pressure chambers 21 are formed on the first substrate 26 so as to be aligned in parallel in a second direction D2. The respective pressure chambers 21 are connected to supply ports 23 through narrow portions 22 having narrow inner widths. The respective supply ports 23 communicate with the common liquid chambers 24 formed on the second substrate 27 (FIG. 1). Further, the lower portions of the respective pressure chambers 21 at the side opposite to the narrow portions 22 communicate with communication ports 25 formed on the second substrate 27. It is to be noted that the communication ports 25 are openings communicating with nozzle holes 61 on the nozzle plate 60 as will be described later.

The common liquid chambers 24 are formed in the vicinity of the pressure chambers 21 on the first substrate 26. The common liquid chambers 24 and the pressure chambers are defined in the first substrate 26 through wall portions. The common liquid chambers 24 are configured by combining spaces formed on the first substrate 26 and the second substrate 27. As illustrated in FIG. 3, the common liquid chambers 24 and the pressure chambers 21 have openings 24*a* and 21*a* on the first substrate 26 at the upper surface 26*a* side (first direction), respectively. The common liquid chambers 24 form the openings 24*a* having widths that are substantially the same as the width defined by the pressure chambers 21 located at both ends in the second direction D2 on the first substrate 26. The common liquid chambers 24 on the second substrate 27 communicate with the supply ports 23 formed on the first substrate 26.

As a material of the flow path formation substrate 20, partially-stabilized zirconia (Zr) or stabilized zirconia can be used. Alternatively, metal or the like may be used as the material of the flow path formation substrate 20.

Further, the vibration plate 10 is superimposed on the upper surface 26*a* of the first substrate 26 on the flow path formation substrate 20. As illustrated in FIG. 1, the vibration plate 10 is fixed to the flow path formation substrate 20 so as to cover the pressure chambers 21 on the flow path formation substrate 20.

The vibration plate 10 is configured by a thin plate member made of ceramics, for example. As a material thereof, partially-stabilized zirconia, stabilized zirconia, or silicon dioxide ($SiO_2$) can be used. A thickness of the vibration plate 10 in a third direction D3 can be set to 2.2 μm to 6.0 μm, for example. An insulating film may be formed on the upper surface of the vibration plate 10 at the side opposite to the flow path formation substrate 20 in order to suppress liquid permeation property.

The piezoelectric elements 30 are positioned on the vibration plate 10 at the side that is not fixed to the flow path formation substrate 20. Each piezoelectric element 30 includes a lower electrode 31, an upper electrode 33, and a piezoelectric body (active part) 32 located between the lower electrode 31 and the upper electrode 33. In the first embodiment, the upper electrode 33 functions as an individual electrode provided for each piezoelectric body 32. On the other hand, the lower electrode 31 functions as a common electrode for supplying a common potential to the respective piezoelectric bodies 32.

As illustrated in FIG. 4, the lower electrode 31 includes branch portions 311 and a signal input portion 312. The branch portions 311 are arranged for the respective pressure chambers 21. The signal input portion 312 is connected to a circuit substrate (not illustrated). The respective branch portions 311 are arranged on the vibration plate 10 continuously from upper portions (also referred to as active regions) of the pressure chambers 21 to the outside of the active regions. On the other hand, the signal input portion 312 is formed on the vibration plate 10 at a position other than the active regions so as to be aligned in parallel with the respective branch portions 311. One end (right end in FIG. 4) of the signal input portion 312 is formed to be thicker than other portions. The signal input portion 312 is connected to the wiring from the circuit substrate on the thick portion.

The lower electrodes 31 and the upper electrodes 33 are formed with a conductive material including metal such as layered gold (Au) or platinum (Pt), for example. A thickness of the lower electrodes 31 can be set to 1.0 μm to 2.0 μm. Furthermore, the piezoelectric bodies 32 are formed with a dielectric body such as lead zirconium titanate (PZT), for example.

The head member 50 is fixed to the flow path formation substrate 20 at the side at which the piezoelectric elements 30 are formed. The head member 50 is formed into a box shape, for example, and includes a slit 51 and recesses 52. The slit 51 positions the circuit substrate (not illustrated) and the like, and cables. The recesses 52 are opened on the head member 50 at the side that is fixed to the vibration plate 10. The circuit substrate and the like that are inserted into the slit 51 are electrically connected to the upper electrodes 33 or the lower electrode 31 of the piezoelectric elements 30. Further, the recesses 52 include inlet paths 71 through which ink (liquid) is supplied from an ink cartridge, which will be described later, flows.

Each inlet path 71 is constituted by a first inlet port 53 and a conductive inlet path formation portion (conductive member) 54. The first inlet port 53 is formed by the inner wall of the head member 50. The inlet path formation portion 54 is located in the vicinity of the opening of the common liquid chamber 24. The inlet path formation portion 54 has a slit-like second inlet port 55 communicating with the first inlet port 53.

The lower surface (surface at the side facing the flow path formation substrate 20) of the inlet path formation portion 54 is electrically connected to the lower electrode 31. That is to say, as illustrated in FIG. 4, the inlet path formation portion 54 is connected to the branch portions 311 and the signal input portion 312 constituting the lower electrode 31 so as to be conductive with each other. Therefore, the signal input portion 312 and the respective branch portions 311 are conductive with each other through the inlet path formation portion 54.

In the first embodiment, the inlet path formation portions 54 and the lower electrodes 31 are connected to each other through adhesion layers 80. The adhesion layers can enable electrical connection. As an example of an adhesive forming the adhesion layers 80, an anisotropic conductive adhesion film (ACF) or a conductive adhesive can be used. Further, a method of connecting the inlet path formation portions 54 and the lower electrodes 31 is not limited to the method using the adhesion layers 80. The inlet path formation portions 54 and the lower electrodes 31 may be connected by another method such as brazing or direct thermal welding.

Further, any material may be used for the inlet path formation portions 54 as long as it has conductive property. For example, gold (Au), platinum (Pt), stainless steel (SUS), or the like can be applied as the material of the inlet path formation portions 54.

In the first embodiment, a potential of ink applied to the liquid flow paths 70 and a potential of a common voltage that is applied to the lower electrodes 31 are the same potential (for example, 0 volts). The lower electrodes 31 and the ink are electrically connected through the inlet path formation portions 54. Therefore, the potential of the ink (liquid) applied through the inlet path formation portions 54 is set to be the same as the potential generated on the lower electrodes 31 so as to make the potential generated on the lower electrodes 31 more stable.

The nozzle plate 60 is fixed to the flow path formation substrate 20 at the second substrate 27 side. Therefore, the nozzle plate 60 seals the lower side of the flow path formation substrate 20. The nozzle plate 60 is a thin plate member in which a plurality of nozzle holes 61 are formed along the second direction D2 at a predetermined interval. The respective nozzle holes 61 are formed so as to communicate with the respective communication ports 25 in the flow path formation substrate 20.

The nozzle plate 60 is formed with ceramics using partially-stabilized zirconia or stabilized zirconia, or metal, for example.

The nozzle plate 60 may employ the following configuration. That is, a plurality of nozzle rows in which the plurality of nozzle holes 61 are formed along the second direction D2 are aligned in parallel in a first direction D1, and one nozzle row and the other nozzle row are arranged so as to be shifted in the second direction D2 (arranged in a so-called zigzag form).

Another substrate such as a communication port substrate may be provided between the flow path formation substrate 20 and the nozzle plate 60.

In the liquid ejecting head 1 having the above-mentioned configuration, the respective substrates are superimposed in a laminate manner. With this, the pressure chambers 21 communicate with the nozzle holes 61 through the communication ports 25. Further, the pressure chambers 21 communicate with the common liquid chambers 24 through the supply ports 23. The inlet paths 71 on the head member 50 communicate with the openings of the common liquid chambers 24. As a result, the inlet paths 71 and the liquid flow paths 70 communicate with each other.

The ink supplied through the inlet paths 71 on the head member 50 is filled into the liquid flow paths 70 through the common liquid chambers 24. In this state, if a driving voltage is applied to the lower electrodes 31 and the upper electrodes 33 from the circuit substrate (not illustrated), the piezoelectric elements 30 are driven. The driving of the piezoelectric elements 30 vibrates the vibration plate 10 so as to generate pressure fluctuations in the pressure chambers 21. Then, the pressure fluctuations in the pressure chambers 21 cause the ink filled into the communication ports 25 to be ejected to the outside through the nozzle holes 61.

The liquid ejecting head 1 constitutes a part of an ink jet recording head unit including an ink supply path communicating with an ink cartridge and the like and is mounted on an ink jet printer 200. The ink jet printer 200 is an example of a liquid ejecting apparatus.

Figure 5:
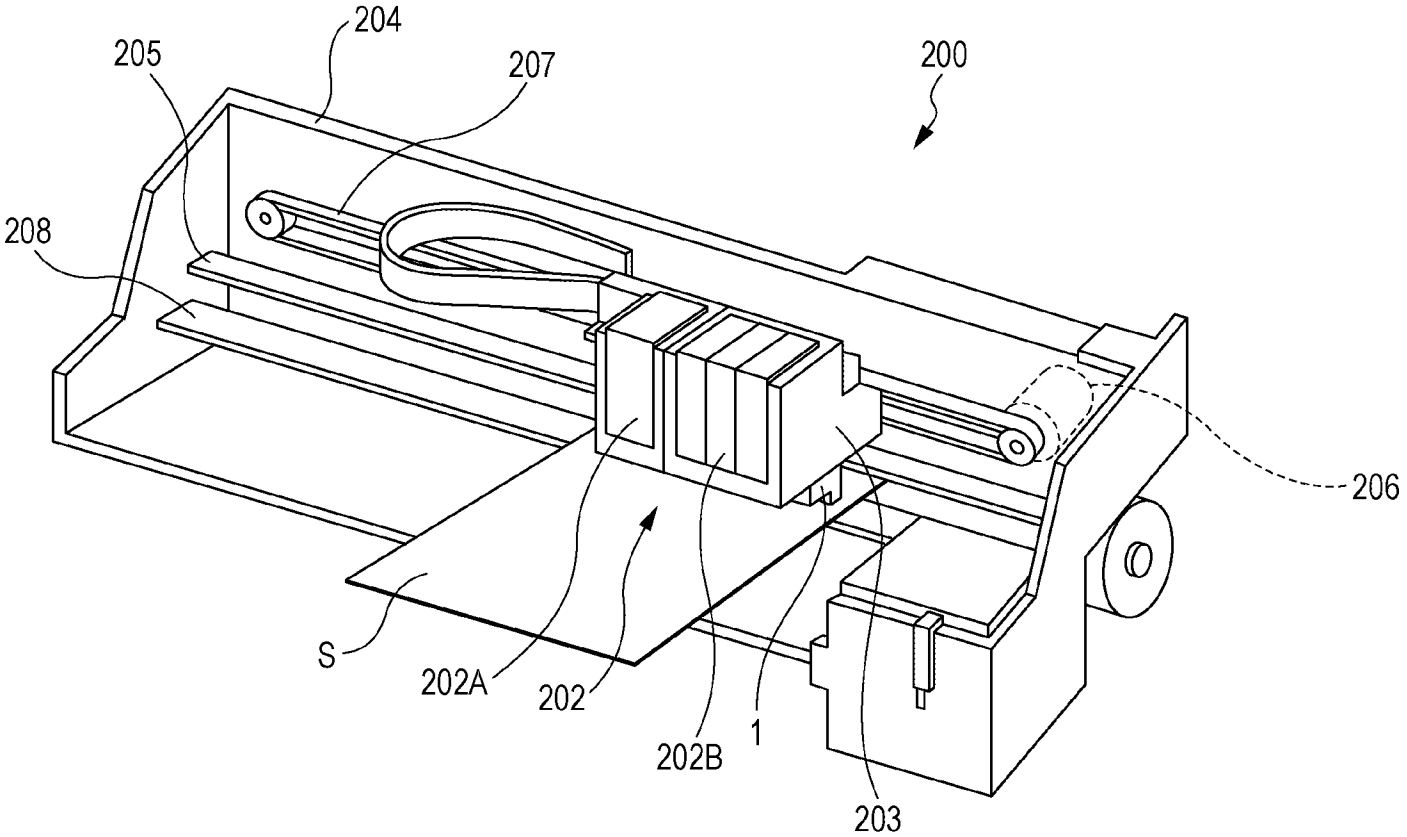
FIG. 5 is a schematic view illustrating an example of an ink jet printer.

FIG. 5 is a schematic view illustrating an example of the ink jet printer 200. In FIG. 5, a reference numeral 1 indicates a part of a housing (head cover) that accommodates therein the liquid ejecting heads 1 in a state where nozzle hole surfaces thereof are exposed to the outside. In the ink jet printer 200, for example, ink cartridges 202A and 202B, and the like are provided on an ink jet recording head unit (hereinafter, head unit 202) in a detachable manner. The head unit 202 includes the plurality of liquid ejecting heads 1. A carriage 203 on which the head unit 202 is mounted is provided on a carriage shaft 205 so as to be movable in a shaft direction. The carriage shaft 205 is attached to an apparatus main body 204. If a driving force of a driving motor 206 is transmitted to the carriage 203 through a plurality of gears (not illustrated) and a timing belt 207, the carriage 203 moves along the carriage shaft 205.

A platen 208 is provided on the apparatus main body 204 along the carriage shaft 205. A print medium S supplied by a roller (not illustrated) and the like is transported on the platen 208. Ink is ejected onto the print medium S being transported through the nozzle holes 61 of the liquid ejecting heads 1, so that an arbitrary image is printed on the print medium S. It is to be noted that the ink jet printer 200 is not limited to having a configuration in which the head unit 202 moves as described above and may be also a so-called line head-type printer in which the liquid ejecting heads 1 are fixed and printing is performed only by moving the print medium S, for example.

Next, a method of manufacturing the liquid ejecting head is described.

First, ceramic sheets before being sintered, which correspond to the vibration plate 10, the first substrate 26, and the second substrate 27, are prepared. Then, a punching process is performed on the ceramic sheets to be formed as the first substrate 26 and the second substrate 27 so as to form through-holes corresponding to the pressure chambers 21, the common liquid chambers 24, the communication ports 25, and the supply ports 23. Subsequently, the ceramic sheets corresponding to the vibration plate 10, the first substrate 26, and the second substrate 27 are laminated one another and sintered integrally.

Thereafter, the lower electrodes 31 are formed on the vibration plate 10. The lower electrodes 31 are formed as follows. A metal solution to be the lower electrodes 31 is applied to the upper surface of the vibration plate 10 by a sputtering method, for example. The metal solution is sintered so as to form a metal film. Subsequently, the metal film is patterned to form the branch portions 311 and the signal input portions 312 so as to be independent.

Then, the piezoelectric bodies 32 are formed on the respective branch portions 311 of the lower electrodes 31. For example, the piezoelectric bodies 32 are formed as follows. That is, a precursor is applied to the lower electrodes 31 by a spin coat method or the like, and then, is sintered. Thereafter, the layer after sintered is patterned so as to form the piezoelectric bodies 32 for the respective pressure chambers 21. The upper electrodes 33 are formed on the piezoelectric bodies 32.

Next, the nozzle plate 60 is bonded to the flow path formation substrate 20. For example, the nozzle plate 60 is bonded to the flow path formation substrate 20 by using an adhesive, for example. An epoxy-based adhesive can be used as the adhesive. Note that the nozzle plate 60 can be formed by sintering a ceramic sheet as a material.

Finally, the head member 50 is bonded to the vibration plate 10. The inlet path formation portions 54 are fixed to the head member 50. The head member 50 is bonded such that the inlet path formation portions 54 are electrically conductive with the branch portions 311 and the signal input portions 312 of the lower electrodes 31.

The liquid ejecting head 1 according to the first embodiment is manufactured with the above-mentioned processes.

As described above, in the first embodiment, the lower electrodes 31 (common electrodes) of the piezoelectric elements 30 are electrically connected to the inlet path formation portions 54 (conductive member) located at the same sides. Therefore, the lower electrodes 31 and the inlet path formation portions 54 are conductive with each other so as to lower the wiring resistance of the lower electrodes 31. As a result, electric crosstalk between the piezoelectric elements and dullness of driving signals for driving the piezoelectric elements 30 can be improved. This enables the liquid ejecting head 1 to be driven appropriately. Further, the wiring regions of the lower electrodes 31 can be made small, thereby reducing the liquid ejecting head in size.

Second Embodiment

Figure 6:
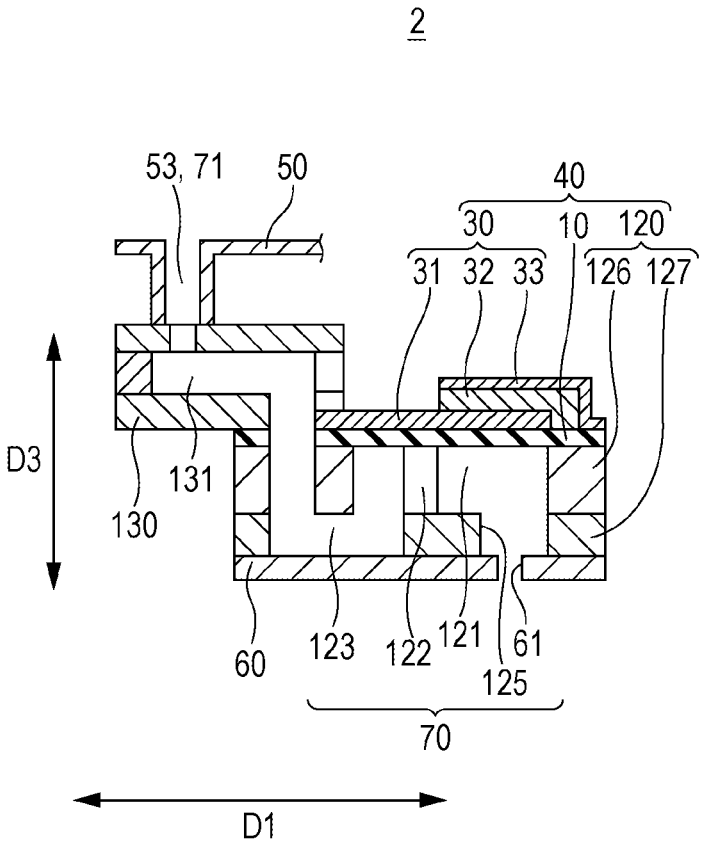
FIG. 6 is a cross-sectional view illustrating a liquid ejecting head according to a second embodiment.
Figure 7:
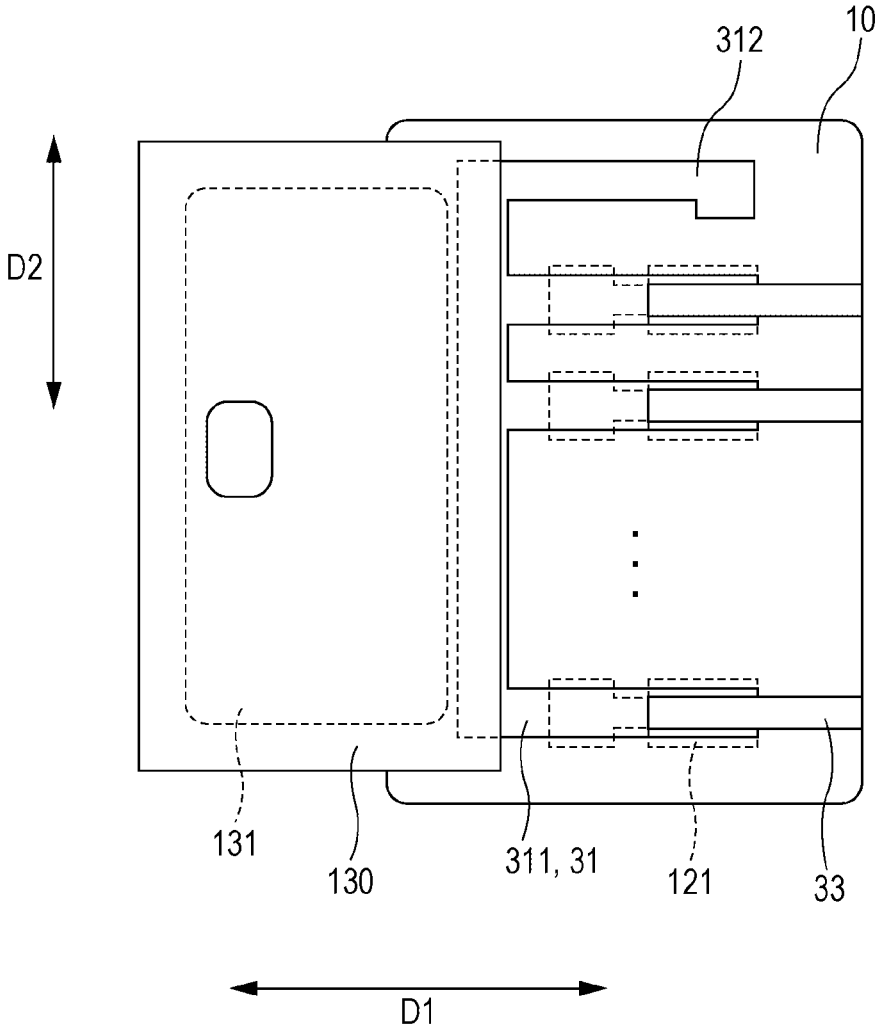
FIG. 7 is a view for explaining the liquid ejecting head according to the second embodiment.

FIG. 6 is a cross-sectional view for explaining a liquid ejecting head according to a second embodiment. FIG. 7 is a view for explaining the liquid ejecting head according to the second embodiment.

In the second embodiment, a liquid ejecting head 2 is different from the liquid ejecting head 1 according to the first embodiment in a configuration in which reservoir members 130 including common liquid chambers 131 are provided at the outside of a flow path formation substrate 120. The reservoir members 130 are configured by conductive members and are connected to the lower electrodes 31. In the second embodiment, the lower electrodes 31 and the signal input portions 312 are wired so as to be continuous to each other. In the case, the wiring resistance of the lower electrodes 31 can be also lowered.

As in the first embodiment, the liquid ejecting head 2 includes the flow path unit 40, the nozzle plate 60, and the head member 50. The flow path unit 40 includes the vibration plate 10, the flow path formation substrate 120, the piezoelectric elements 30, and the reservoir members 130.

As in the first embodiment, a plurality of pressure chambers 121 are formed on a first substrate 126 so as to be aligned in parallel in the second direction D2. The respective pressure chambers 121 communicate with supply ports 123 through narrow portions 122 having narrow inner widths. The supply ports 123 are formed on each of the first substrate 126 and a second substrate 127. The supply ports 123 are formed as individual flow paths for the respective pressure chambers 121 in the flow path formation substrate 120. Therefore, in the second embodiment, the flow path formation substrate 120 does not include the common liquid chamber therein. Further, lower portions of the pressure chambers 121 at the side that does not communicate with the narrow portions 122 communicate with the communication ports 125 formed on the second substrate 127.

On the other hand, the flow path formation substrate 120 at the side of the supply ports 123 is connected to the reservoir members 130. The reservoir members 130 include the common liquid chambers 131 therein. The reservoir members 130 at the upper surface side communicate with the inlet paths 71 of the head member 50 and the reservoir members 130 at the lower surface side communicate with the supply ports 123 of the flow path formation substrate 120. The common liquid chambers 131 serve as flow paths common to the plurality of supply ports 123. Therefore, the common liquid chambers 131 are located between the inlet paths 71 of the head member 50 and the supply ports 123 of the flow path formation substrate 120.

As illustrated in FIG. 7, the lower surface of each reservoir member 130 is electrically connected to the lower electrode 31. That is to say, each reservoir member 130 at the lower surface side is connected to the branch portions 311 and the signal input portion 312 constituting the lower electrode 31 so as to be conductive with each other. Therefore, the branch portions 311 and the signal input portion 312 are conductive with each other through the reservoir member 130.

Also in the second embodiment, the reservoir members 130 and the lower electrodes 31 may be connected to each other through adhesion layers that enable electrical connection. However, the reservoir members 130 and the lower electrodes 31 are not limited to being connected to each other in the above-mentioned manner and may be connected to each other by thermal welding. Further, any material may be used for the conductive members 130 as long as it has conductive property. Gold (Au), platinum (Pt), stainless steel (SUS), or the like can be applied as the material of the conductive member 130.

As described above, with the second embodiment, the same effects as those achieved by the liquid ejecting head according to the first embodiment can be obtained. In addition, the common liquid chambers 131 are located at the outside of the flow path formation substrate 120 so as to simplify the configuration of the flow path formation substrate 120. As a result, the size of the liquid ejecting head can be reduced, for example.

Other Embodiments

The first embodiment and the second embodiment may be combined or the following variations may be combined.

For example, also in the first embodiment, the lower electrodes 31 and the signal input portions 312 may be wired continuously. In contrary, also in the second embodiment, the lower electrodes 31 and the signal input portions 312 may be independent and may not be continuous to each other.

In the liquid ejecting heads according to these embodiments, the upper electrodes may be set to common electrodes and the lower electrodes may be set to individual electrodes.

When the potential of the liquid applied to the liquid flow paths and the potential of the common electrodes are not made to be identical, for example, an insulating film or an insulting member may be formed on the inner flow path walls of the conductive members so as to make the liquid and the lower electrodes insulate from each other.

Instead of the configuration in which one piezoelectric element is provided for one pressure chamber, the following configuration may be employed. That is, one piezoelectric element may be provided so as to generate pressure on a plurality of pressure chambers. In this case, the piezoelectric body may be provided continuously on the plurality of active regions.

The basic configuration of the liquid ejecting heads according to the embodiments is not limited to those as described above. The invention is widely applied to general liquid ejecting heads. It is needless to say that the invention can be also applied to liquid ejecting heads which use pressure generation elements other than the piezoelectric elements, such as heat generation elements, or liquid ejecting heads which eject liquid other than ink. As other liquid ejecting heads, various recording heads used for image recording apparatuses such as a printer, color material ejecting heads used for manufacturing color filters of a liquid crystal display, electrode material ejecting heads used for forming electrodes of an organic EL display and a field emission display (FED), bioorganic compound ejecting heads used for manufacturing a bio chip, and the like can be exemplified.

It is needless to say that the invention is not limited to the above-mentioned embodiments.

That is to say, members, configurations, and the like as disclosed in the above-mentioned embodiments, which can be replaced by one another, may be applied while combinations thereof are changed appropriately.

The members, the configurations, and the like as disclosed in the above-mentioned embodiments may be replaced appropriately by well-known replaceable members, configurations, and the like, and combinations thereof may be changed to be applied.

The members, the configurations, and the like as disclosed in the above-mentioned embodiments may be replaced appropriately by members, configurations, and the like, which can be supposed as substitutions by those skilled in the art based on the well-known techniques and the like, and combinations thereof may be changed to be applied.

The entire disclosure of Japanese Patent Application No. 2013-048971, filed Mar. 12, 2013 is incorporated by reference herein.

What is claimed is:

1. A liquid ejecting head that ejects liquid comprising:

a flow path member that includes a plurality of pressure chambers through which the liquid flows;

pressure generation elements that include active parts arranged at positions corresponding to the pressure chambers and a common electrode for generating a common potential to the respective pressure chambers; and a conductive member that is electrically connected to the common electrode on the flow path member at the side to which the pressure generation elements are fixed and lowers resistance of the common electrode, wherein the conductive member forms a part of a wall of a flow path of the liquid, that communicates with the pressure chambers, and the conductive member and the liquid are electrically connected to each other.

2. A liquid ejecting head that ejects liquid, the liquid ejecting head comprising:

a flow path member that includes a plurality of pressure chambers through which the liquid flows;

pressure generation elements that include active parts arranged at positions corresponding to the pressure chambers and a common electrode for generating a common potential to the respective pressure chambers; and a conductive member that is electrically connected to the common electrode on the flow path member at the side to which the pressure generation elements are fixed and lowers resistance of the common electrode, wherein the conductive member forms a part of a wall of a flow path of the liquid, that communicates with the pressure chambers, and the conductive member communicates with the plurality of pressure chambers and serves as a common liquid chamber shared by the respective pressure chambers.

3. The liquid ejecting head according to claim 1, wherein the common electrode includes individual electrodes arranged for the respective pressure chambers, and the individual electrodes are conductive with one another through the conductive member.

4. A liquid ejecting apparatus comprising the liquid ejecting head according to claim 1.

* * * * *